US010377023B2

(12) United States Patent
Söderlund

(10) Patent No.: US 10,377,023 B2
(45) Date of Patent: Aug. 13, 2019

(54) HYDRAULIC TORQUE IMPULSE GENERATOR

(71) Applicant: ATLAS COPCO INDUSTRIAL TECHNIQUE AB, Stockholm (SE)

(72) Inventor: Per Thomas Söderlund, Värmdö (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 497 days.

(21) Appl. No.: 15/106,747

(22) PCT Filed: Dec. 19, 2014

(86) PCT No.: PCT/EP2014/078812
§ 371 (c)(1),
(2) Date: Jun. 20, 2016

(87) PCT Pub. No.: WO2015/097092
PCT Pub. Date: Jul. 2, 2015

(65) Prior Publication Data

US 2017/0001289 A1 Jan. 5, 2017

(30) Foreign Application Priority Data

Dec. 27, 2013 (SE) ..... 1351584

(51) Int. Cl.
*B25B 21/02* (2006.01)

(52) U.S. Cl.
CPC ..... *B25B 21/026* (2013.01)

(58) Field of Classification Search
CPC ... B25B 21/026; B25B 23/14; B25B 23/1453; B25B 21/02; B25B 23/1405;
(Continued)

(56) References Cited

U.S. PATENT DOCUMENTS 3,283,537 A 11/1966 Gillis
4,120,604 A * 10/1978 Garofalo ..... B25B 21/00 173/177

(Continued)

FOREIGN PATENT DOCUMENTS

EP 0243334 A1 10/1987
EP 0290411 A2 11/1988
WO 9114541 A1 10/1991

OTHER PUBLICATIONS

International Search Report (ISR), Written Opinion (WO) and International Preliminary Report on Patentability (IPRP) dated Apr. 15, 2015 issued in International Application No. PCT/EP2014/078812.

*Primary Examiner* — Hemant Desai
*Assistant Examiner* — Amelia Jae-Ippel Vorce
(74) *Attorney, Agent, or Firm* — Holtz, Holtz & Volek PC

(57) ABSTRACT

A hydraulic torque impulse generator includes a drive cylinder with a hydraulic fluid chamber, an output shaft with an impulse receiving portion connected to a radially movable seal element and intermittently dividing the hydraulic fluid chamber into high and low pressure compartments, and cam profiles which can displace the seal element from an idling position to a high pressure pulse generating position. A by-pass passage communicates fluid between the high and low pressure compartments, and a valve element movable between closed and open positions controls the fluid flow. The valve element is closed during pressure build-up in the high pressure compartment and opens when a high pressure pulse is completed, and is part of a control spindle coupled to the drive cylinder. The control spindle rotates through an angular play by inherent kinetic energy at an abrupt stop of the drive cylinder at the generation of each high pressure pulse.

4 Claims, 4 Drawing Sheets

(58) Field of Classification Search
CPC ... B25B 23/145; B25B 23/147; B25B 23/141; B25B 23/1456; B25B 23/0064; B25B 23/1425; B25B 23/1475; B25B 21/008; B25B 21/005; B25B 21/007; B25B 21/023; B25B 13/48; B25B 21/002; B25B 23/00; B25B 23/0078; B25B 31/00
USPC ..... 173/2–183, 200
See application file for complete search history.

(56) References Cited

U.S. PATENT DOCUMENTS

| | | | | |
|---|---|---|---|---|
| 4,735,595 | A * | 4/1988 | Schoeps | B25B 21/02 173/93 |
| 4,854,916 | A | 8/1989 | Schoeps et al. | |
| 4,884,995 | A | 12/1989 | Schoeps | |
| 4,951,756 | A * | 8/1990 | Everett | B25B 23/145 173/178 |
| 5,092,410 | A | 3/1992 | Wallace et al. | |
| 2008/0066941 | A1* | 3/2008 | Kobayashi | B25B 21/00 173/218 |
| 2014/0374461 | A1* | 12/2014 | Pedicini | B25C 1/06 227/2 |

* cited by examiner

HYDRAULIC TORQUE IMPULSE GENERATOR

TECHNICAL FIELD

The invention relates to a torque impulse generator which comprises a motor driven drive cylinder with a hydraulic chamber, and an impulse receiving portion of an output shaft extending into the drive cylinder and carrying at least one radially movable sealing element arranged to cooperate with sealing lands in the hydraulic fluid chamber for intermittently dividing the hydraulic chamber into a high pressure compartment and a low pressure compartment to thereby generate a torque impulse in the output shaft.

BACKGROUND

Impulse generators of the above described type are arranged to generate torque impulses as the sealing element or elements at a certain angular position seal off a high pressure compartment from a low pressure compartment in the hydraulic fluid chamber. At each generated torque impulse the kinetic energy of the drive cylinder is transferred to the impulse receiving portion of the output shaft via the sealing element or elements and a high pressure peak built up in the high pressure compartment. This results in an almost instantaneous stop of the rotation of the drive cylinder relative to the output shaft whereby the kinetic energy of the drive cylinder is transferred to the output shaft. Although the driving torque of the motor continuously acts on the cylinder, acceleration of the drive cylinder to generate another impulse is initially hindered in that the hydraulic pressure in the high pressure compartment only slowly decreases via leakage clearances past the sealing elements. This means that the impulse rate of the impulse generator becomes rather low. If the leakage clearances were widened between the sealing element or elements and the cylinder it would be possible to shorten the stop phases of the cylinder after each impulse has been delivered and thereby increase the impulse rate. However, widened leakage clearance would also lead to that the high pressure pulses would be severely reduced in magnitude and, although the impulse rate is increased, the efficiency of the impulse generator would be limited in an undesirable way.

In a previously known way, described in U.S. Pat. No. 4,735,595, the impulse rate of a torque impulse generator is increased in that a spring type valve element is arranged to open up a by-pass connection between the high pressure compartment and the low pressure compartment immediately after a high pressure pulse has been generated. This means that there will be no remaining pressure in the high pressure compartment to hinder or delay a quick acceleration of the drive cylinder before a next coming impulse, and hence limit the impulse rate of the impulse generator.

In a similar way, described in U.S. Pat. No. 3,233,537, a spring biased by-pass valve device in the drive cylinder is arranged to drain the remaining pressure in the high pressure compartment as soon as an impulse has been delivered to thereby increase the impulse rate of the torque impulse generator.

Both the above related prior art devices suffer from a drawback in that they are pressure activated, which means that they start closing the by-pass connection as the pressure in the high pressure compartment reaches a certain level. This means that they are still open during the initial part of the pressure build-up in the high pressure compartment, which means that a certain part of the hydraulic fluid in the high pressure compartment will be communicated to the low pressure compartment before the high pressure compartment is fully closed and the impulse generating high pressure pulse is to be created. The result is an undesired reduction of the accomplished pulse pressure in the high pressure compartment and hence an impaired torque impulse force. In the same way this known type of valve device does not open up a by-pass communication until the pressure in the high pressure compartment has decreased to a certain level which means an undesired delay in the acceleration before the next coming torque impulse.

SHORT DESCRIPTION OF THE INVENTION

It is an object of the invention to provide a torque impulse generator of the above type wherein the impulse rate is increased without impairing the efficiency of the torque impulse generation.

The invention relates to a hydraulic torque impulse generator comprising a motor driven drive cylinder with a hydraulic fluid chamber, an output shaft with an impulse receiving portion coaxial with the drive cylinder and connected to at least one radially movable seal element supported on the impulse receiving portion and intermittently dividing the hydraulic chamber into a high pressure compartment and a low pressure compartment, and cam profiles arranged to displace said at least one seal element from an idling position to a high pressure pulse generating position, wherein a by-pass passage is provided to communicate fluid between the high pressure compartment and the low pressure compartment, and a valve element movable between a closed position and an open position to thereby control the fluid flow through the by-pass passage. The valve element is coupled to and co-rotatable with the drive cylinder, said valve element being arranged to occupy its closed position during pressure build-up in the high pressure compartment and to be shifted to its open position as soon as a high pressure pulse has been completed.

With the hydraulic torque impulse generator of the invention the impulse rate is increased due to the provision of the by-pass valve device that operates independently of the fluid pressure level in the high pressure compartment and instead is controlled by the rotational position of the drive cylinder.

In a specific embodiment of the invention the high pressure compartment is formed in the impulse receiving portion, and said at least one seal element are two in number and movable towards each other in the high pressure compartment, and the cam profiles are provided on an inner wall of the hydraulic chamber and arranged to urge said seal elements simultaneously towards each other in said high pressure compartment.

In another embodiment of the invention the valve element is a part of a control spindle which is coupled to the drive cylinder via a lost motion coupling providing an angular play between the control spindle and the drive cylinder, and said control spindle is arranged to rotate through said angular play by its inherent kinetic energy at the abrupt stop of the drive cylinder at the generation of each high pressure pulse, whereby the valve element is shifted to its open position.

Cam projections may be provided on the control spindle to engage and return the seal elements to their idling positions before another high pressure pulse is to be generated.

Further characteristic features and advantages of the invention will appear from the following detailed description below, in which a specific embodiment of the invention is described with reference to the accompanying drawings.

SHORT DESCRIPTION OF THE DRAWINGS

DETAILED DESCRIPTION OF THE INVENTION

Figure 3:
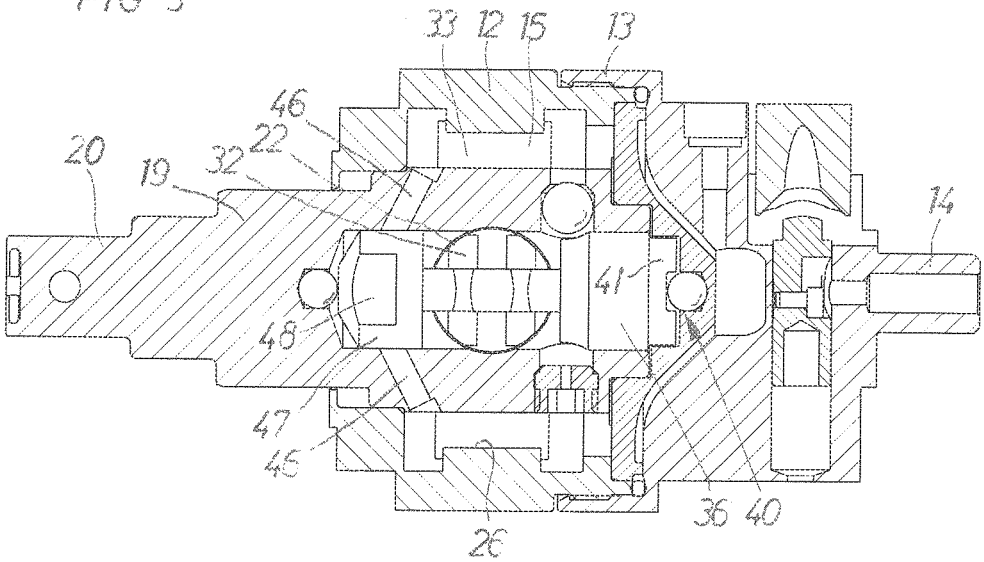
FIG. 3 shows a longitudinal section similar to FIG. 2 illustrating the by-pass valve in closed position.
Figure 4:
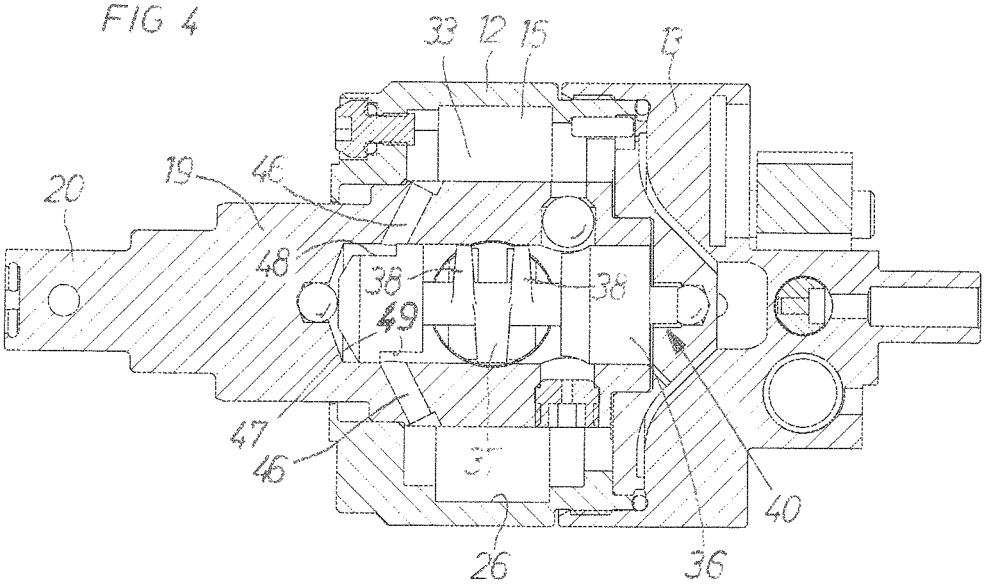
FIG. 4 shows a longitudinal section similar to FIG. 3 illustrating the by-pass valve in open position.
Figure 8:
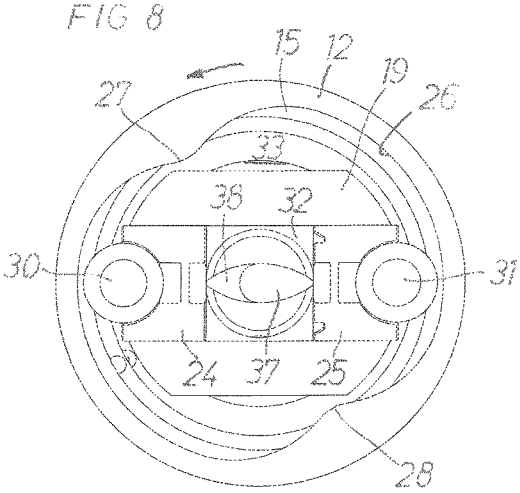
FIG. 8 shows a cross section along line B-B in FIG. 2 illustrating the pistons pushed out to their idling positions by the cam projections on the control spindle.
Figure 9:
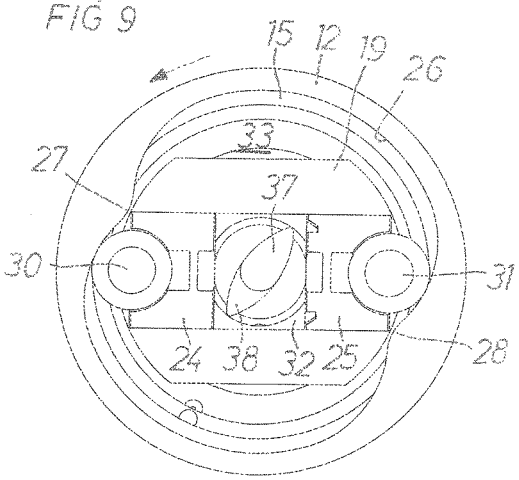
FIG. 9 shows a cross section similar to FIG. 8 illustrating a impulse generating phase where the piston push rollers are engaged by the cam profiles on the drive cylinder and press the pistons towards each other in the high pressure compartment.
Figure 10:
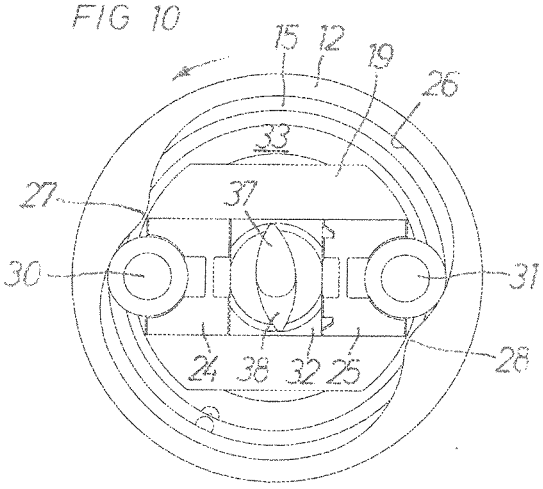
FIG. 10 shows a cross section similar to FIGS. 8 and 9 illustrating an inertia related further angular displacement of the control spindle and the cam projections.

The torque impulse generator shown in the drawings comprises an inertia drive cylinder 12 with an internal cylindrical fluid chamber 15, a rear end wall 13 and a shaft 14 for connection to the motor. Through a front opening 18 of the cylinder 12 there extends an impulse receiving portion 19 of an output shaft 20. This portion 19 has a transverse bore 22 in which two pistons 24,25 (also referred to as "seal elements") are radially movable. See FIG. 3. As illustrated in FIGS. 8-10, the inner wall 26 of the fluid chamber 15 is formed with two diametrically opposed cam profiles 27,28 by which the pistons 24,25 are activated via two push rollers 30,31. Thereby, the pistons 24,25 are displaced from and towards each other, respectively, in the bore 22, and when displaced towards each other the pistons 24,25 enclose a fluid volume between them which is compressed to a high pressure. In other words the pistons 24,25 enclose a high pressure compartment 32 between them, whereas a low pressure compartment 33 is formed in the fluid chamber 15 surrounding the impulse receiving portion 19.

Figure 12:
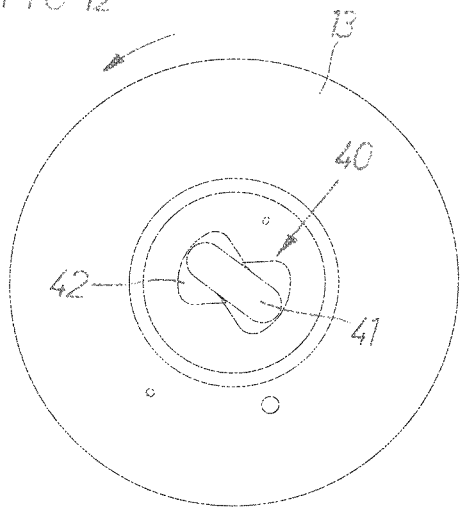
FIG. 12 shows a cross section similar to FIG. 11 illustrating an impulse generating position of the cylinder and an initial part of an inertia related further rotation of the control spindle.
Figure 13:
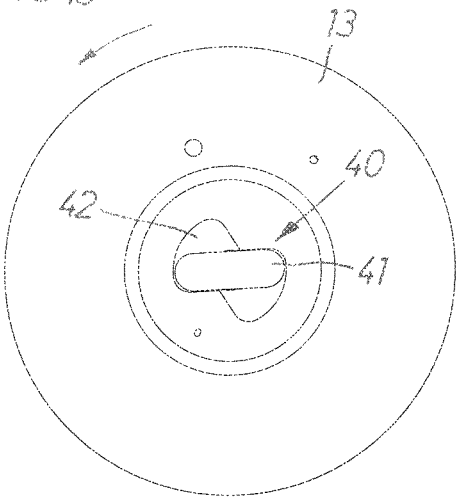
FIG. 13 shows a cross section similar to FIGS. 11 and 12 illustrating a completed full inertia related further rotational displacement of the control spindle.

To ensure that the pistons 24,25 and their push rollers 30,31 are returned to their outer idling positions for engagement with the cam profiles 27,28 there is provided a control spindle 36 which is disposed concentrically with and rotated by the drive cylinder 12. The control spindle 36 is provided with oppositely extended cam projections 37,38 for sequential engagement with the pistons 24,25 and is drivingly coupled to the drive cylinder 12 via a lost motion coupling 40 which comprises a transverse ridge portion 41 arranged to engage a sandglass-shaped socket portion 42 in the rear end wall 13 of the fluid chamber 15. Accordingly, there is provided for a rotational play between the drive cylinder 12 and the control spindle 36. See FIGS. 11-13. To ensure a low friction bearing arrangement between the drive cylinder 12 and the control spindle 36 there are provided balls 43,44 on which the ends of the control spindle 36 rest.

There is provided a valve means for controlling a by-pass flow of hydraulic fluid between the high pressure compartment 32 and the low pressure compartment 33 to promote an increased impulse rate of the impulse generator without impairing the efficiency or magnitude of each delivered impulse. To that end the impulse receiving portion 19 is provided with a by-pass passage 46 and a valve element 47. The latter is cylindrical in shape and formed with passage forming grooves 48,49 for sequentially opening up of the by-pass passage 46 and allow fluid to flow between the high pressure compartment 32 and low pressure compartment 33.

The valve element 47 is provided at one end of the control spindle 36 as an integrated part of the latter.

Figure 1:
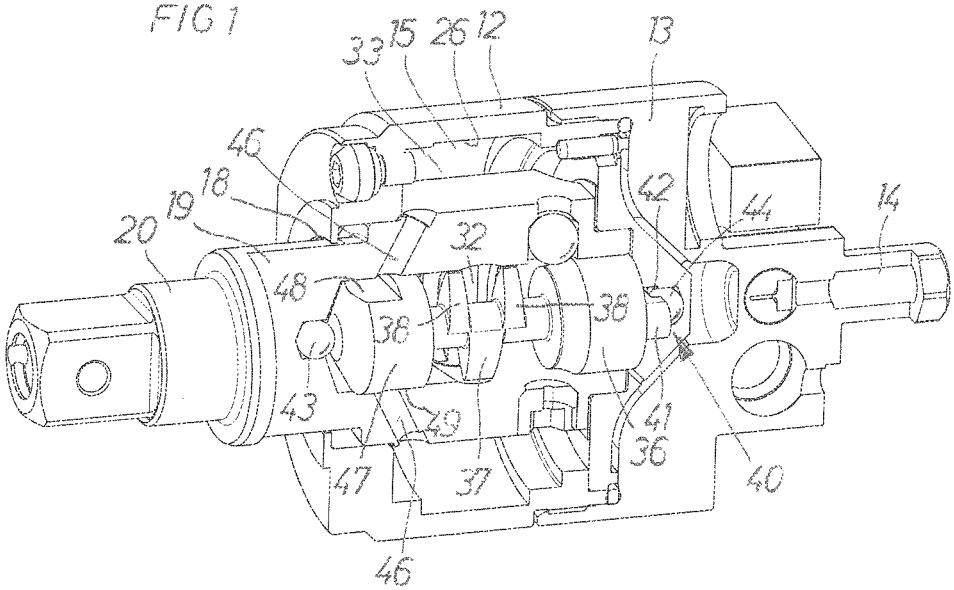
FIG. 1 shows a perspective view of a torque impulse generator according to the invention.
Figure 2:
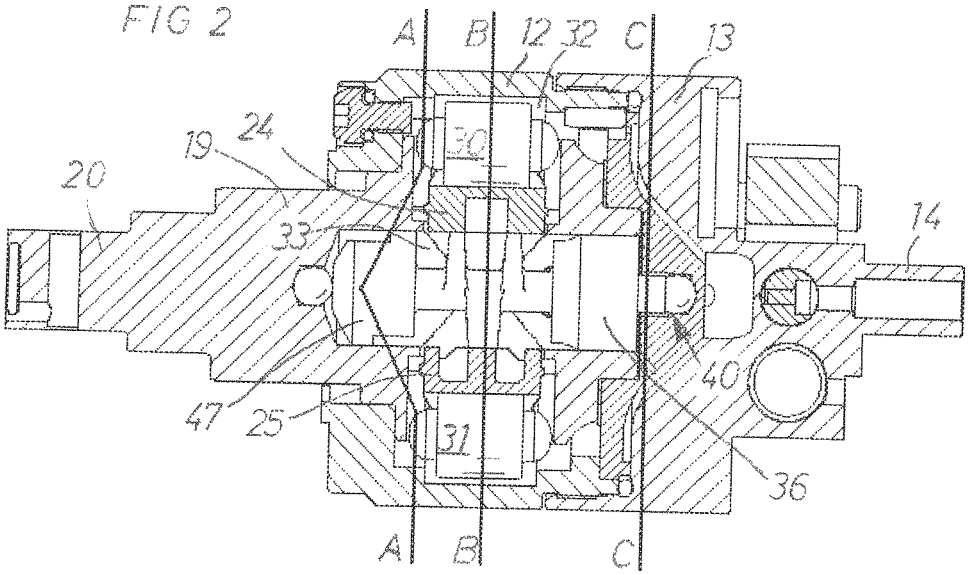
FIG. 2 shows a longitudinal section through the impulse generator in FIG. 1 illustrating the pistons in idling positions.

The operation order of the impulse generator is described below with reference to the drawing figures, wherein the different phases of the operation will be described with reference to the cross sections A-A, B-B and C-C illustrated in FIG. 2.

Figure 5:
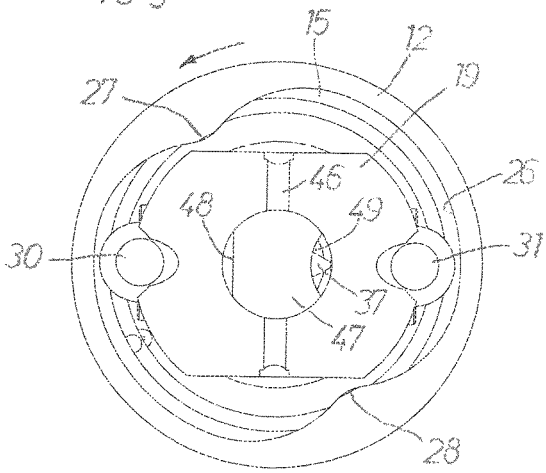
FIG. 5 shows a cross section along line A-A in FIG. 2 illustrating the by-pass valve in closed position.

In operation the rear shaft 14 of the drive cylinder 12 is connected to a non-illustrated motor to receive a constant torque. This means that the drive cylinder 12 is rotated in relation to the output shaft 20 and the impulse receiving portion 19 in a direction marked by arrows in the figures. In a first phase, illustrated in FIGS. 5, 8 and 11, the pistons 24,25 have been shifted to their outer idling positions, see FIGS. 5,8, by the cam projections 37,38 on the control spindle 36. As is illustrated in FIG. 5 the by-pass passage 46 is closed by the valve element 47 in that the grooves 48,49 of the latter are out of alignment with by-pass passage 46. In this phase the control spindle 36 is rotated together with the drive cylinder 12 as the ridge portion 41 on the control spindle 36 is engaged by the sandglass-shaped socket portion 42 in the drive cylinder end wall 13. See FIG. 11. This is an acceleration phase wherein the drive cylinder 12 gathers speed and kinetic energy before an upcoming impulse generation. The cam profiles 27,28 on the fluid chamber inner wall 26 have not yet reached the push rollers 30,31 to activate the pistons 24,25.

Figure 6:
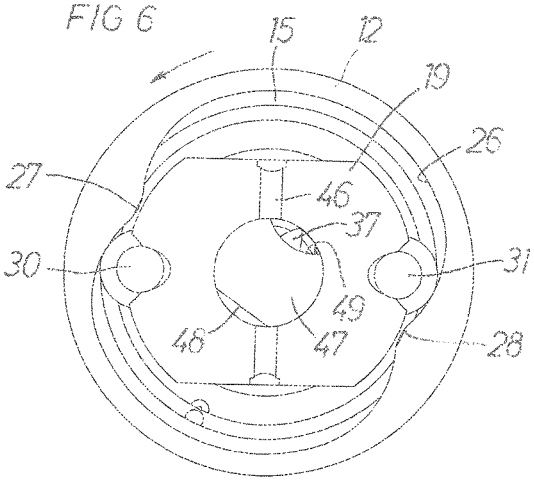
FIG. 6 shows a cross section similar to FIG. 5 illustrating the end phase of an impulse generating phase with the by-pass valve in a part-open position.
Figure 11:
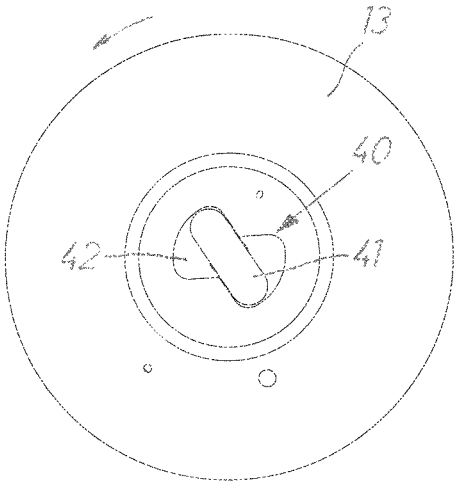
FIG. 11 shows a cross section along line C-C in FIG. 2 illustrating the lost motion coupling between the drive cylinder (an inertia cylinder) and the control spindle in a position in which the control spindle is rotated by the cylinder.

In a following phase, illustrated in FIGS. 6, 9 and 11, the cam profiles 27,28 have reached a position in which they engage the push rollers 30,31 whereby oppositely directed forces are applied on the pistons 24,25. In this phase the control spindle 36 has reached a position where the cam projections 37,38 are no longer in contact with the pistons 24,25 to allow radial displacements of the pistons 24,25 towards each other. A rapidly increasing fluid pressure in the high pressure compartment 32 is achieved and the kinetic energy of the drive cylinder 12 is transferred to the output shaft 20 via the impulse receiving portion 19. This means that the drive cylinder 12 is abruptly stopped.

Figure 7:
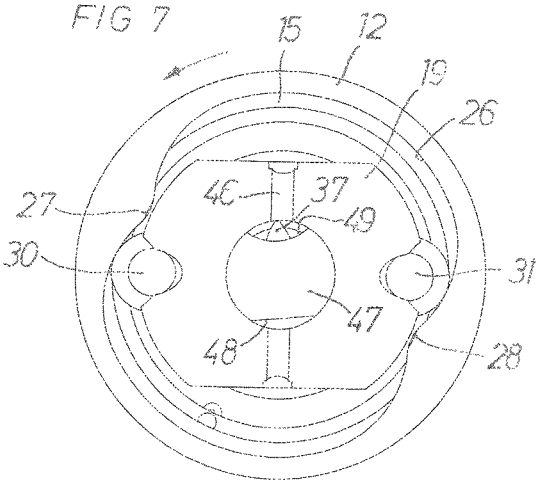
FIG. 7 shows a cross section similar to FIGS. 5 and 6 illustrating a completed impulse generating phase with the by-pass valve in fully open position.

In this impulse delivering phase and due to the abrupt stop of the drive cylinder 12 the control spindle 36 continues to rotate a certain angular interval by its own inertia. This angular interval is determined by the lost motion coupling 40, and in an initial phase position the ridge portion 41 has moved away from its driving engagement with sandglass-shaped socket portion 42 in the drive cylinder end wall 13. See FIG. 12. Consequently, the valve element 47 is also rotated during this interval, and has reached a position where the grooves 48,49 start to open up the fluid communication through the by-pass passage 46. See FIG. 6. Immediately following this phase the control spindle 36 has reached its fully displaced position which is determined by the shape of the sandglass-shaped socket portion 42. See FIG. 13. When the control spindle 36 is in that position the valve element 47 has reached its fully open position wherein the grooves 48,49 allow a full fluid flow through the by-pass passage 46. See FIG. 7. In FIG. 10 this position is illustrated by the cam projections 37,38 occupying further displaced positions relative to the pistons 24,25.

The above described operation order of the control spindle 36 and the valve element 47 results in a very quick removal of the pressure in the high pressure compartment 32 immediately after a torque impulse has been delivered. This means that the drive cylinder 12 is able to gather speed before another impulse generation without any time delay due to remaining pressure in the high pressure compartment 32, and hence an increased impulse rate without a negative influence on the magnitude of the generated impulses. The operation order of the by-pass valve is determined by the relative angular positions of the drive cylinder 12 and the impulse receiving portion 19 of the output shaft 20 and the inertia driven further rotation movement of the control spindle 36. Differently from the pressure controlled valve arrangements described in prior art there is neither any undesirable by-pass flow of fluid during the initial phase of the impulse generation phase nor any delayed pressure removal from the high pressure compartment 32 immediately after the impulse generating phase. This means higher impulse magnitudes and a higher impulse rate.

It is to be understood that embodiments of the invention are not limited to the above described example but may be freely varied within scope of the claims. The invention may for instance be applied on vane types of impulse generators where the problem with delayed drive cylinder acceleration also occurs.

The invention claimed is:

1. A hydraulic torque impulse generator comprising:

a motor driven drive cylinder with a hydraulic fluid chamber;

an output shaft with an impulse receiving portion coaxial with the drive cylinder and connected to at least one radially movable seal element supported on the impulse receiving portion and intermittently dividing the hydraulic fluid chamber into a high pressure compartment and a low pressure compartment;

cam profiles provided on an inner wall of the hydraulic fluid chamber and engageable with the at least one seal element to displace the at least one seal element from an idling position to a high pressure pulse generating position;

a by-pass passage to communicate fluid between the high pressure compartment and the low pressure compartment; and a valve element, movable between a closed position and an open position to thereby control fluid flow through the by-pass passage, wherein:

the valve element is coupled to and co-rotatable with the drive cylinder, said valve element being arranged to occupy its closed position during pressure build-up in the high pressure compartment and to be shifted to its open position as soon as a high pressure pulse has been completed, and the valve element is a part of a control spindle that is coupled to the drive cylinder via a lost motion coupling providing an angular play between the control spindle and the drive cylinder, and said control spindle is arranged to rotate through said angular play by its inherent kinetic energy at an abrupt stop of the drive cylinder at generation of each high pressure pulse, whereby the valve element is shifted to its open position.

2. The impulse generator according to claim 1, wherein:

the high pressure compartment is formed in the impulse receiving portion, said at least one seal element are two in number and movable towards each other in the high pressure compartment, and the cam profiles are engageable with said seal elements to urge said seal elements simultaneously towards each other in said high pressure compartment.

3. The impulse generator according to claim 1, wherein cam projections are provided on the control spindle to engage and return the at least one seal element to its idling position before another high pressure pulse is to be generated.

4. The impulse generator according to claim 2, wherein cam projections are provided on the control spindle to engage and return the seal elements to their idling positions before another high pressure pulse is to be generated.

* * * * *